US008695770B2

(12) United States Patent
Santy

(10) Patent No.: US 8,695,770 B2
(45) Date of Patent: Apr. 15, 2014

(54) LUGGAGE HAVING BOTTOM FRAME MEMBER

(75) Inventor: Dirk Santy, Koekelare (BE)

(73) Assignee: Samsonite IP Holdings S.a.r.l., Luxembourg (LU)

( * ) Notice: Subject to any disclaimer, the term of this patent is extended or adjusted under 35 U.S.C. 154(b) by 573 days.

(21) Appl. No.: 12/834,249

(22) Filed: Jul. 12, 2010

(65) Prior Publication Data

US 2012/0006640 A1 Jan. 12, 2012

(51) Int. Cl.
*A45C 13/36* (2006.01)

(52) U.S. Cl.
USPC ..... 190/127; 190/115; 190/124; 383/119

(58) Field of Classification Search
USPC ..... 150/130; 190/127, 902, 115, 124; 383/33, 119
See application file for complete search history.

(56) References Cited

U.S. PATENT DOCUMENTS

| | | | | |
|---|---|---|---|---|
| 2,423,003 | A * | 6/1947 | Buegeleisen | 224/423 |
| 4,610,333 | A * | 9/1986 | Seynhaeve | 190/18 A |
| 5,482,147 | A * | 1/1996 | Wang | 190/115 |
| 6,068,095 | A * | 5/2000 | Glembocki et al. | 190/127 |
| 6,148,973 | A * | 11/2000 | Chang | 190/127 |
| 6,293,378 | B1 * | 9/2001 | Lin | 190/24 |
| 6,302,250 | B1 * | 10/2001 | Sadow et al. | 190/18 A |
| 6,499,575 | B1 | 12/2002 | Tsai | |
| D505,789 | S | 6/2005 | Nykoluk | |
| 6,926,129 | B2 | 8/2005 | Hoberman | |
| 7,048,101 | B2 | 5/2006 | Godshaw et al. | |
| 7,077,252 | B2 | 7/2006 | Sanchez | |
| 7,188,714 | B1 | 3/2007 | Herold | |
| 7,219,902 | B1 | 5/2007 | Herold | |
| 7,500,547 | B2 | 3/2009 | Bettua et al. | |
| 2002/0125089 | A1 | 9/2002 | Davis et al. | |
| 2004/0007433 | A1 * | 1/2004 | Godshaw et al. | 190/18 A |
| 2004/0065518 | A1 | 4/2004 | Hoberman | |
| 2005/0150732 | A1 * | 7/2005 | Costa et al. | 190/115 |
| 2006/0237108 | A1 | 10/2006 | Herold | |
| 2009/0101460 | A1 * | 4/2009 | Justham et al. | 190/16 |
| 2009/0120752 | A1 | 5/2009 | Bettua et al. | |

FOREIGN PATENT DOCUMENTS

| | | |
|---|---|---|
| FR | 2563093 | 10/1985 |
| GB | 2339679 A | 2/2000 |

OTHER PUBLICATIONS

Mar. 31, 2009, http://indocastlemedia.com/blog/2009/03/31/hour-glass-shaped-watch/.*

International Search Report of corresponding International Application No. PCT/EP2011/061888, dated Dec. 1, 2011, 4 pages.

* cited by examiner

*Primary Examiner* — Tri Mai
(74) *Attorney, Agent, or Firm* — Dorsey & Whitney LLP

(57) ABSTRACT

Generally, embodiments discussed herein may include an article of softside luggage including flexible portions formed from flexible material and a rigid or semi-rigid reinforcing member. One embodiment may take the form of a wheeled duffel including a base wall, a top wall opposite the base wall, a plurality of sidewalls extending upwardly from the base wall to the top wall, a top end wall, and a bottom end wall opposite the top end wall. The wheeled duffel may further include a reinforcing member forming the top and bottom end walls and extending along the base wall from the top end wall to the bottom end wall. The reinforcing member may have an hourglass shape.

13 Claims, 4 Drawing Sheets

LUGGAGE HAVING BOTTOM FRAME MEMBER

TECHNICAL FIELD

Embodiments disclosed herein relate to luggage cases, and in particular, to a duffel including flexible side portions and a rigid bottom frame member.

BACKGROUND

Generally, luggage cases fall into two basic categories of construction. The first, generally called "hardside" luggage, may include luggage cases made of generally rigid materials forming a generally box shape. Typically, the sides of hardside luggage have a generally rigid, resilient construction. The second, generally called "softside" luggage, incorporates portions of hardside construction together with generally soft, flexible portions. Softside luggage may include a soft fabric body portion and a rigid reinforcing frame for maintaining the shape of the otherwise collapsible fabric body portion.

However, existing softside luggage configurations continue to emulate the generally box-like shape of hardside luggage cases, making them bulky, difficult to carry, and sometimes hard to pack due to their bulk. Accordingly, such softside luggage configurations are not conducive to use during travel because they cannot be easily stored or transported.

From the foregoing, it can be appreciated that a need exists for a lightweight article of luggage that can be easily stored and transported during travel, while providing considerable structural support.

SUMMARY

Generally, embodiments discussed herein may include an article of softside luggage including flexible portions formed from flexible material and a rigid or semi-rigid reinforcing member. The reinforcing member may have an hourglass configuration or shape, such that the member is wider at the top and bottom portions of the luggage than toward the center of the luggage. The reinforcing member may form the top and bottom end walls of the luggage, and may extend along the base of the luggage between the top and bottom end walls. The base of the luggage may further include flexible side portions on opposite sides of the reinforcing member.

One embodiment takes the form of a wheeled duffel including a base wall, a top wall opposite the base wall, a plurality of sidewalls extending upwardly from the base wall to the top wall, a top end wall, and a bottom end wall opposite the top end wall. The wheeled duffel may further include a reinforcing member forming the top and bottom end walls and extending along the base wall from the top end wall to the bottom end wall. The reinforcing member may have an hourglass shape.

Another embodiment takes the form of an article of luggage. The article of luggage may include a base wall, a top wall opposite the base wall, a plurality of sidewalls extending upwardly from the base wall to the top wall, a top end wall, and a bottom end wall opposite the top end wall. A reinforcing member may extend along the top end wall, the base wall, and the bottom end wall. The reinforcing member may have a gradually decreasing width toward a central portion of the article of luggage.

A further embodiment takes the form of an article of luggage. The article of luggage may include a base wall, a top wall opposite the base wall, a plurality of sidewalls extending upwardly from the base wall to the top wall, a top end wall, and a bottom end wall opposite the top end wall. The article of luggage may further include a reinforcing member including a top portion forming the top end wall, a bottom portion forming the bottom end wall, and a central portion extending along at least a portion of the base wall. The reinforcing member may have a gradually decreasing width toward the central portion of the article of luggage. The article of luggage may further include one or more pultrusion bars extending along the base wall between the top end wall and the bottom end wall.

Other aspects, features and details of the embodiments disclosed herein can be more completely understood by reference to the following detailed description of a preferred embodiment taken in conjunction with the drawings and from the dependent claims.

BRIEF DESCRIPTION

DETAILED DESCRIPTION

Figure 1A:
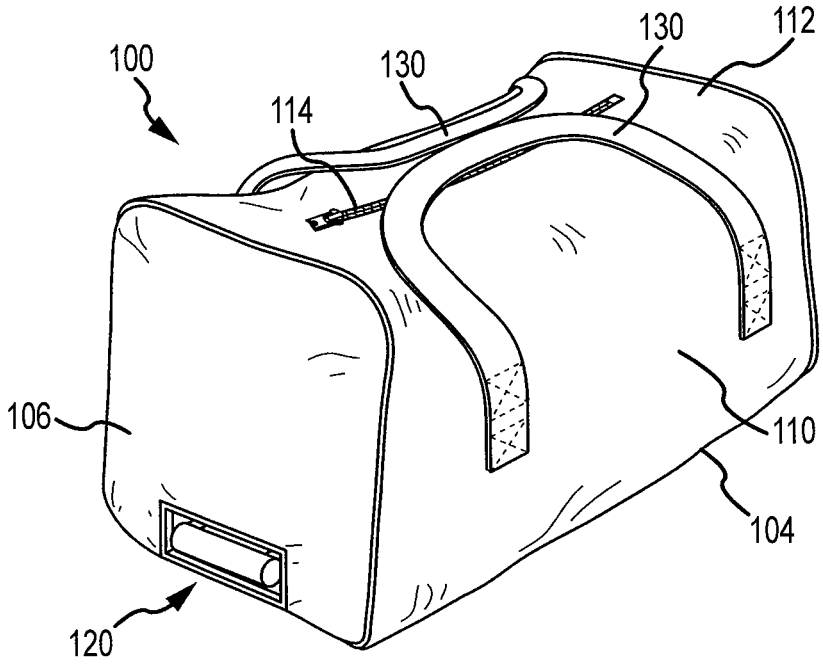
FIG. 1A illustrates a front perspective view of one embodiment of an article of luggage.

Generally, embodiments discussed herein may include a wheeled duffel including flexible portions formed from flexible material and a rigid or semi-rigid reinforcing member. The reinforcing member may have an hourglass configuration or shape, such that the member is wider at the top and bottom portions of the duffel than toward the center of the duffel. The reinforcing member may form the top and bottom end walls of the duffel, and may extend along the base of the duffel between the top and bottom end walls. The base of the duffel may further include flexible side portions on opposite sides of the reinforcing member.

Referring now to the drawings, and more particularly to FIGS. 1A-1D, one embodiment of an article of luggage 100 is illustrated. The article of luggage 100 is a wheeled or rolling duffel in the illustrated embodiment, although it will be appreciated that other embodiments are not limited to use with a rolling duffel and may be applicable to a non-wheeled duffel bag or any other article of luggage having flexible sides and a semi-rigid frame.

The article of luggage 100 may include a base wall 104. Top and bottom end walls 106 and 108 may be connected to the base wall 104, with side walls 110 extending upwardly from the base wall 104 between the end walls 106, 108. In one embodiment, a top wall 112 may be attached to, or integrally formed with, the side walls 110 and the end walls 106, 108.

The top wall 112 may include a fastening mechanism for opening and closing the article of luggage 100. As is shown, the top wall 112 may have a zipper 114 that extends along a portion of the top wall between the top end wall 106 to the bottom end wall 108. In an alternative embodiment, the top wall 112 may have a zipper 114 that extends around at least a portion of the periphery of the top wall 112 so the top wall 112 may form a flap that is hingedly connected to one of the side or end walls. It will be appreciated that any fastener configuration may be employed. For example, in some embodiments, the zipper 114 may extend around the entire periphery of the top wall 112 so that the top wall 112 may be removed. Additionally, any other form of fastener such as hook and loop fasteners or snap fasteners may be employed to close the top wall 112.

In one embodiment, the article of luggage 100 may also include an extendable handle system 120. The handle system 120 is shown in a retracted position in FIG. 1A and in an extended position in FIG. 1C. Referring to FIG. 1C, the extendable handle system 120 may include two extendable vertical members or poles 122 having a horizontal handle portion 124 coupled between a top portion of the vertical members 122. In other embodiments, the extendable handle may have a single pole. Also, whether having dual poles or single poles, the extendable handle may be curved toward or away from the baggage. The extendable handle system may be mounted to the reinforcing member by rivets, clamps, or sewing. In one embodiment, the handle system 120 may include a locking mechanism to allow for locking of the handle system 120 in an extended, intermediate, and/or stowed position. For example, the locking mechanism may be a button located on the horizontal handle portion 124. However, other embodiments may include other types of locking mechanisms, or may not have a locking mechanism.

As is shown, the article of luggage 100 may include one or more wheels 126 located at the bottom end of the luggage 100. In one embodiment, the luggage 100 may have two wheels 126 that are located on opposite sides of the bottom end wall 108. The wheels may each be connected to respective axles to allow for rotation of the wheels with respect to the luggage 100. The wheels may be anchored in housings which are attached to the reinforcing member. Each housing includes the wheel and associated axle. Alternatively, the wheel may be pivotally supported on an axle directly mounted to the reinforcing member. As is known, the article of luggage 102 may be towed on the wheels 126 using the adjustable handle system 120. The article of luggage 100 may also include more than two wheels, such as having 4 caster wheels, or may have no wheels.

Additionally, some embodiments may include one or more feet 121 attached to the bottom end wall 108 for placing the article of luggage 102 flat on bottom end wall 108 without tipping forward or backward. Similarly, some embodiments may include one or more feet 123 attached to the base wall 104 to help prevent wear of the base wall 104 resting on a surface.

Figure 1B:
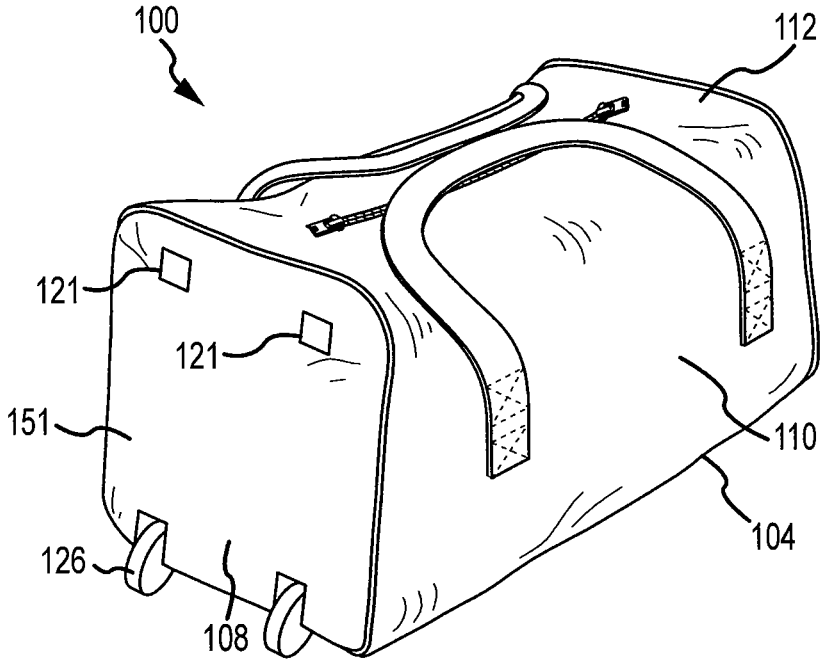
FIG. 1B illustrates a rear perspective view of the article of luggage shown in FIG. 1A.
Figure 1C:
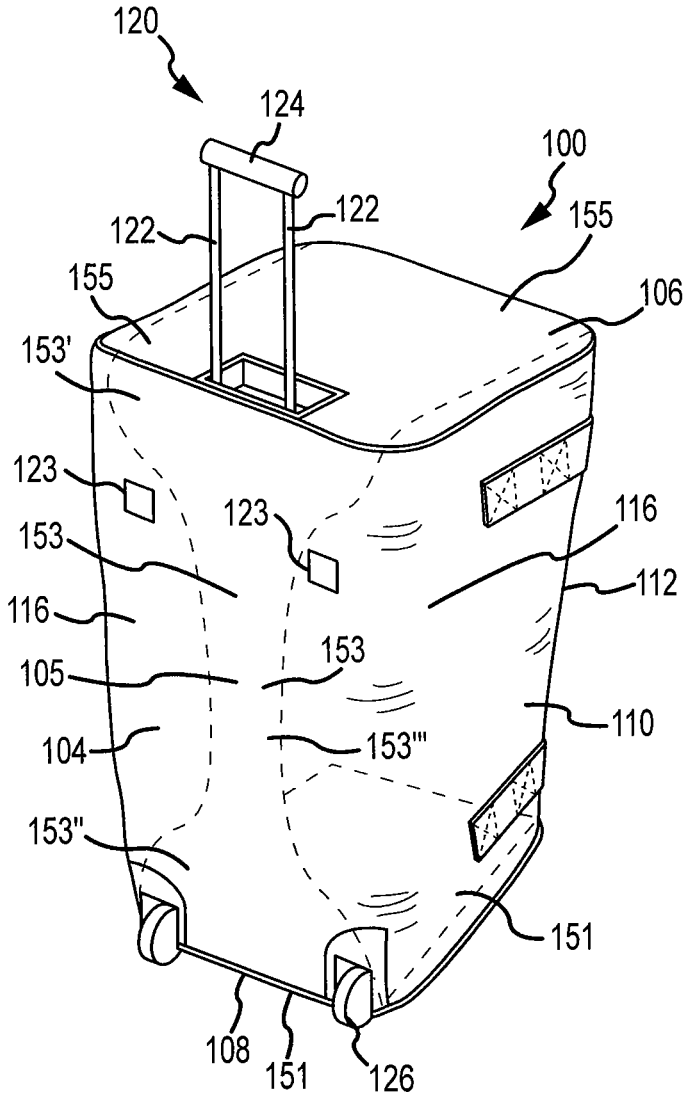
FIG. 1C illustrates a bottom perspective view of the article of luggage shown in FIG. 1A in an upright position, with the extendible handle in an extended position.

Referring to FIGS. 1A and 1B, the side and top walls 110, 112 may be formed from a flexible material. In one embodiment, the top wall 112 may be formed from the same piece of material as the side walls 110 so that the side walls 110 extend seamlessly upward to form the top wall 112. Accordingly, the side walls 110 and top wall 112 may be depressed toward the interior of the article of luggage 100 due to forces impacting on the exterior of the luggage 110, such as when the luggage 110 is in a crowded storage area, stored in a small space, or being carried. This may facilitate storage of the luggage in compact storage area, such as the overhead compartment of an airplane, a crowded or small closet, and so on.

As shown in FIGS. 1A and 1B, one or more handles 130 may be attached to the side walls 100 so that the article of luggage 100 may be picked up like a conventional duffel bag. In other embodiments, the handles 130 may be attached to the top wall 112, instead of the side walls 100. Further embodiments may include a shoulder strap that extends from the ends 106, 108 over the top wall 112.

The sidewalls 110 and top wall 112 may be formed from any type of flexible fabric material. For example, the walls may be formed from polyurethane, nylon, cotton, polyester, foam, any combination thereof, and so on. While an article of luggage 100 including generally soft side and top walls 110, 112 is illustrated, other embodiments may include rigid reinforcing members that extend along all or part of the side and/or top walls, typically along the interior thereof. For example, the top wall 112 may include a rigid or semi-rigid reinforcing member that extends along a portion of the top wall to maintain a particular shape when the luggage 100 is empty or picked up.

In some embodiments, pockets may be provided on the exterior of side walls 110, or any other suitable location on the article of luggage 100. The pockets may be opened and closed by any suitable fastener, such as a zipper, snap fastener, and so on. Alternatively, the pockets may simply be open at their tops and not be fastenable. Similarly, one or more pockets may be provided on the interior the side walls 110, within the article of luggage 100.

Figure 1D:
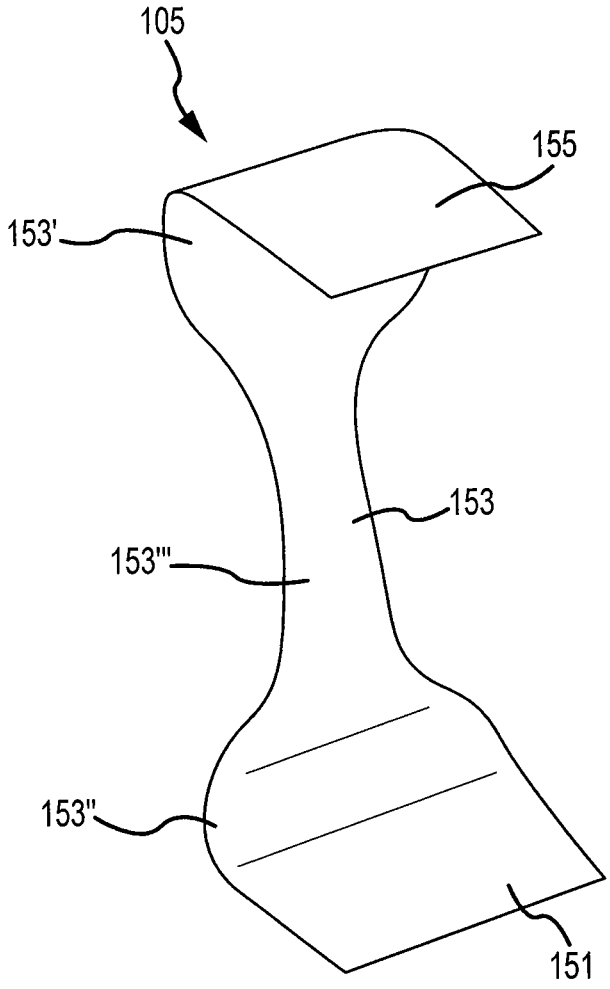
FIG. 1D illustrates a top perspective view of an embodiment of a reinforcing member that may used in conjunction with the article of luggage shown in FIG. 1A.
Figure 2:
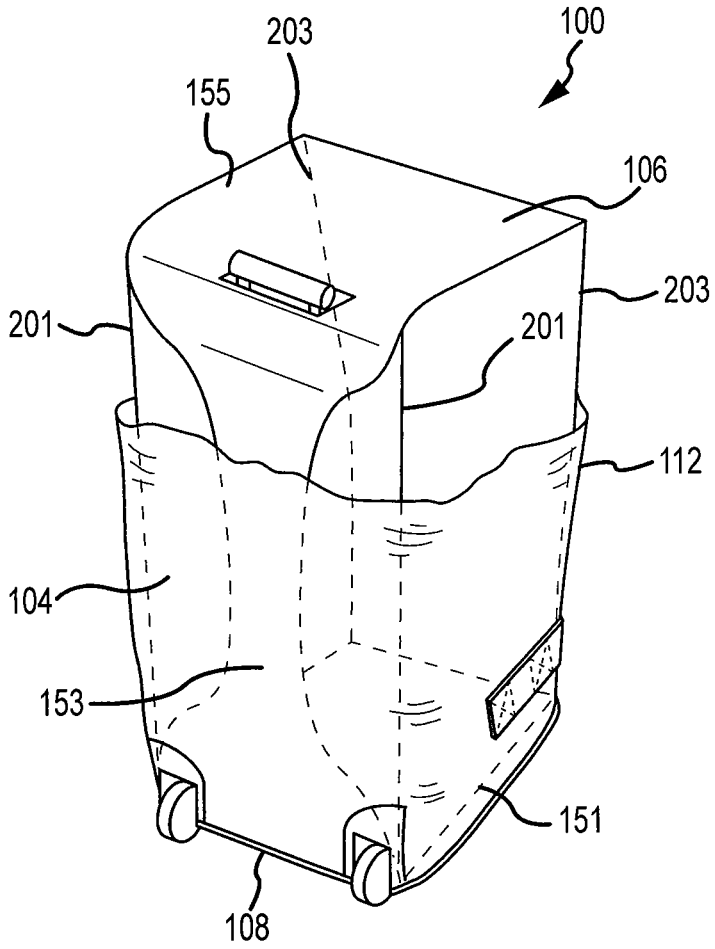
FIG. 2 illustrates a bottom perspective view of another embodiment of an article of luggage in an upright position, with a portion of the flexible material removed to show a portion of the reinforcing member and pultrusion bars of the article of luggage.

Referring to FIG. 1C, the article of luggage 100 may include a reinforcing member 105. One embodiment of a reinforcing member 105 that may be used in conjunction with the article of luggage 100 shown in FIGS. 1A-1D is shown in FIG. 2.

The reinforcing member can take any suitable form. In one embodiment, the reinforcing member 105 may be formed from a single piece of rigid material that is curved or bent to form a bottom portion 151 that extends along at least a portion of the bottom end wall 108, a central portion 153 that extends along the length of the base wall 104, and a top portion 155 that extends along at least a portion of the top end wall 106. As is shown, the reinforcing member 105 may be bent or curved between the bottom and central portions so that the bottom portion is substantially perpendicular to the central portion, as well as between the central and top portions so that the central portion is substantially perpendicular to the top portion. However, in other embodiments, the top and bottom portions may be hingedly connected to the central portion to form straight, rather than curved, edges. Additionally, in some embodiments, the reinforcing member may be formed from multiple pieces of rigid material, rather than a single piece of material.

As discussed above, the reinforcing member 105 may be configured to maintain the shape of the luggage 100. More particularly, the flexible portions of the luggage 100 may be supported by the reinforcing member 105 and prevented from folding or collapsing when the article of luggage 100 is empty. The reinforcing member 105 may also provide structural support for the luggage 100 when filled and may further serve to provide some protection to the contents of the luggage. Additionally, the reinforcing member may further provide structural stability for the extendible handle and/or wheels. In one embodiment, the extendible handle and/or wheels may be attached to the reinforcing member, rather than the flexible material, which may be more prone to tearing or shifting relative to the reinforcing member.

The reinforcing member 105 may be formed from any material that is sufficiently rigid so as to maintain the shape of the luggage and while supporting its contents. For example, the reinforcing member 105 may be formed from polypropylene board, cardboard, wood, metal, plastic, an elastomer, or any other suitable material. In addition, the reinforcing member may be fully or partially concealed. For example, in one embodiment, the reinforcing member may be covered by the flexible material used to form the side and top walls 110, 112, or some other fabric. However, in other embodiments, the reinforcing member may be disposed along the exterior or interior of the luggage 100.

In one embodiment, the reinforcing member 105 may have an hour-glass shape as measured in the width, or lateral, dimension. The reinforcing member 105 has a central portion 153 that extends along the base 104 of the luggage case 100. The end 151 of the reinforcing member 105 extends along the bottom end 108 of the luggage case 100, and the end 155 of the reinforcing member 105 extends along the top end 106 of the luggage case 100. The central portion 153 of the reinforcing member 105 defines opposing ends, 153' (adjacent the end 155) and 153" (adjacent the end 151). These opposing ends are approximately the full width of the corresponding portion of the luggage case over which they extend. In one embodiment, the central portion 153 narrows from each end portion 153' and 153" to a central neck region 153'". The neck region has opposing edges forming a width dimension narrower than the width dimension of the opposing ends 153' and 153". The transition between the opposing end portions 153' and 153" is in the form of a smooth curve, however, the transition may also be stepped, irregular, segmented linear portions, or the like.

The opposing end portions 153' and 153" may have the same width as the ends to which they are adjacent. Opposing end portion 153' is adjacent to end 155, and are shown in FIG. 1D as having the same width, as is shown for end portion 153" and end 151. Ends 151 and 155 may extend the entire width of ends 108 and 106, respectively, or may be less wide. Each of ends 151 and 155 may laterally taper inwardly or outwardly along their length depending on the desired support of the ends 108 and 106 of the luggage 100. Ends 151 and 155 may extend the full length of the ends 108 and 106, respectively (length being used to mean the dimension between base 104 and top 112 of the luggage 100).

As best shown in FIG. 1C, the base wall 104 may include two flexible side portions 116 on either side of the central portion. In one embodiment, the flexible side portions 116 may be formed by the side walls 110 of the luggage 100, which may extend downwardly toward the central portion from opposite sides of the reinforcing member 105. In one embodiment, the side walls 110 and flexible side portions 116 of the base wall 104 may be seamless so that when the duffel is picked up by the handles by a user, the flexible portions are pulled inwardly and upwardly away from the central portion 153 to facilitate carrying by a user. Accordingly, the width of the central portion 153 of the luggage 100 may be reduced when the duffel is picked up. This makes the luggage case more comfortable to carry since there is not an edge of the reinforcing member contacting the user's leg when the luggage case is carried close to a user's body. In one embodiment, the side walls 110, flexible side portions 116 of the base wall 104, and top wall 112 may be formed from a single piece of flexible material. However, in other embodiments, the sidewalls 110, flexible side portions 116, and top wall may be formed from multiple pieces of fabric that are joined together.

Another embodiment of an article of luggage 200 is illustrated in FIG. 2. As shown in FIG. 2, the article of luggage 200 may include pultrusion bars 201 that extend between the top and bottom end walls 106, 108 of the luggage 100 along the side edges of the base wall 104. The pultrusion bars may extend from one end 151 to the other end 155 along a line to help provide the corner shape between the sidewalls 110 and the base 104. Accordingly, the base wall 104 may maintain a generally rectangular shape when, for example, the luggage 100 is filled and/or picked up by the user. In other embodiments, the pultrusion bars 203 may also be provided around all or part of the periphery of the top wall 112 so that the top wall 112 also retains a generally rectangular shape.

Any type of suitable pultrusion bars 201, 203 may be utilized in conjunction with the article of luggage 100. For example, the pultrusion may have a resilient structure so that the luggage 100 may expand or temporarily change shape to accommodate its contents, but may return to its original shape when empty. The pultrusion bars may be resilient so as to bend and flex when contacted by a user's legal when being carried. The pultrusion bars 201, 203 may be formed from a variety of materials, including, but not limited to, thermoplastic, metal, polyester, polyurethane, vinylester, epoxy, and so on.

While the above-described embodiments relate to a wheeled duffel having a bottom frame member, the bottom frame member may also be utilized in conjunction with other forms of luggage. For example, the bottom frame member may be utilized in conjunction with spinner luggage, or other forms of upright luggage. In further embodiments, the luggage may not have wheels, or the wheels may be positioned along the base wall, as opposed to the bottom end wall, of the luggage.

Additionally, although the disclosed embodiments have been described with a certain degree of particularity, it is understood the disclosure has been made by way of example and changes in detail or structure may be made without departing from the spirit of the invention, as defined in the appended claims.

The invention claimed is:

1. A duffel bag comprising:

first wall;

a plurality of flexible sidewalls joined to the first wall;

a first end wall joined to the first wall and the flexible sidewalls;

a second end wall opposite the first end wall and joined to the first wall and the flexible sidewalls;

a platelike reinforcing member extends along the first wall, at least a portion of the first end wall, and at least a portion of to the second end wall;

the platelike reinforcing member has a symmetrical hourglass shape along the first wall and a C-shaped profile, wherein said symmetrical hourglass shape is formed by the platelike reinforcing member comprising a continuous, solid material along the first wall with said continuous, solid plastic material including a width that approximately matches a width of the first wall at opposing ends of the first wall that are adjacent the first end wall and the second end wall, respectively; a narrowing width between these opposing ends; and perimeter edges that define smooth curved transitions between the opposing ends and the narrowed width of said continuous, solid material; and a pair of carry handles, each carry handle operatively associated with one of the plurality of flexible sidewalls.

2. The duffel bag of claim 1, further comprising:

a flexible second wall opposite the first wall;

the plurality of flexible sidewalls extend between the first wall and the flexible second wall;

the first end wall is joined to the flexible second wall; and the second end wall is joined to the flexible second wall.

3. The duffel bag of claim 2, wherein the first wall comprises a base wall, the second wall comprises a top wall, the first end wall comprises a top end wall, and the second end wall comprises a bottom end wall.

4. The duffel bag of claim 2, further comprising one or more bars extending between the first end wall and the second end wall.

5. The duffel bag of claim 4, wherein the bars are pultrusion bars.

6. The duffel bag of claim 4, wherein the one or more bars extend along at least a portion of a periphery of the first wall and at least a portion of a periphery of the flexible second wall, and the one or more bars are positioned on opposite sides of the first wall and the flexible second wall.

7. The duffel bag of claim 1, wherein the platelike reinforcing member includes a first portion that is co-extensive with at least a portion of the first end wall, and a second portion that is co-extensive with at least a portion of the second end wall.

8. The duffel bag of claim 7, wherein the first portion of the platelike reinforcement member extends across an entire width of the first end wall, and the second portion of the platelike reinforcement member extends across an entire width of the second end wall.

9. The duffel bag of claim 7, wherein the first wall comprises flexible side portions on opposite sides of the smooth curved transitions of the continuous, solid material of the platelike reinforcing member, and the flexible side portions collapse inwardly when the article of luggage is picked up by a handle.

10. The duffel bag of claim 1, further comprising wheels operatively attached adjacent the second end wall and an extendable handle that extends from the first end wall, and the wheels and extendable handle are operatively coupled to the platelike reinforcing member.

11. The duffel bag of claim 1, wherein the platelike reinforcing member comprises a single piece of a relatively rigid material.

12. The duffel bag of claim 11, wherein the single piece of relatively rigid material comprises a polypropylene board.

13. The duffel bag of claim 1, wherein the platelike reinforcing member is bent to define at least one curved surface.

* * * * *